United States Patent [19]

Jewett

[11] Patent Number: 5,031,370

[45] Date of Patent: Jul. 16, 1991

[54] COUPLED DRIVE RODS FOR INSTALLING GROUND ANCHORS

[75] Inventor: Thomas E. Jewett, Littleton, Colo.

[73] Assignee: Foresight Industries, Inc., Commerce City, Colo.

[21] Appl. No.: 535,560

[22] Filed: Jun. 11, 1990

[51] Int. Cl.[5] ..... E02D 5/74; F16L 21/00

[52] U.S. Cl. ..... 52/166; 52/163; 285/417

[58] Field of Search ..... 403/230, 118, 307, 343; 52/726, 737, 738, 739, 163, 166; 175/321, 322; 285/417

[56] References Cited

U.S. PATENT DOCUMENTS

| | | | |
|---|---|---|---|
| 339,534 | 4/1886 | Dickson | 285/417 |
| 1,267,250 | 5/1918 | Murray | 285/417 |
| 3,173,524 | 3/1965 | Reduch | 52/163 |
| 4,044,513 | 8/1977 | Deike . | |
| 4,802,317 | 2/1989 | Chandler . | |

OTHER PUBLICATIONS

"Manta Ray" Equipment List and Installation Procedures Foresight Products, Inc. pamphlet.

*Primary Examiner*—Richard E. Chilcot, Jr.
*Assistant Examiner*—Robert J. Canfield
*Attorney, Agent, or Firm*—Hill, Van Santen, Steadman & Simpson

[57] ABSTRACT

Ground anchors are installed by drive rods or gads connected in end to end relation by sleeves or couplers which accommodate sliding of adjacent rod ends into abutting relation under impact or compression loads and which retain the rods in connected string relation under tension loads. The sleeves have smooth rolled internal rope type threads in their end portions separated by a slide chamber receiving mating threads on end portions of adjacent rods which are threaded through and beyond the internal threads into the slide chamber. The rods slide in the sleeves and ends of adjoining rods will abut under compression loads and separate under tension loads while still being retained in end to end relation. A string of drive rods is successively built up to be impacted successively from ground level.

11 Claims, 3 Drawing Sheets

VIII
IX
VI
10
11
12
13
14
15
16
17
18
19
20
21
22
23
24
25
26
27
32
33
34
42
43
R
S
P.R.
F
B
A
L
W

COUPLED DRIVE RODS FOR INSTALLING GROUND ANCHORS

BACKGROUND OF THE INVENTION

Field of the Invention

This invention relates to the art of installing devices such as ground anchors in the ground and particularly deals with coupled drive rods or gads and methods for installing ground anchors wherein a string of drive rods are joined in end to end relation by devices which are not subjected to compression loads, but which hold the rods together in end to end relation under tension loads.

Heretofore drive rods or gads for installing ground anchors and the like have been coupled in end to end relation by internally threaded sleeves or couplings which were unable to hold the rods in abutting relation during impact blows for driving ground anchors or the like into the ground. These sleeves or couplings soon became loose and were forced to carry the compression loads of the impact blows. In effect, the impact blows were delivered through the threads of the couplers or sleeves resulting in energy losses, high temperatures, and early failures.

It would therefore be an improvement in this art to install ground anchors and the like through hammer impacted end to end coupled drive rods or gads without compressively loading any coupling devices while ensuring end to end abutments of the drive rod rods during impact.

It would be a further improvement in this art to provide a method of installing ground anchors of the type driven upright or endwise into the ground to a desired depth by a string of coupled drive rods or gads and then rotated flatwise into a locked position in the ground by a pull member wherein the couplings of the drive rods string are never subjected to impact blows or compression loads but support tension loads to retract the string from the ground.

As used herein, the terms "drive rods" and "gads" include structures driven into the ground especially for installing ground anchors.

SUMMARY OF THE INVENTION

According to this invention, ground anchors and the like are installed by delivering impact blows to the anchors through a string of drive rods connected in end to end relation by couplers which are not subjected to impact blows or compression loads but which support tension loads.

Specifically, according to this invention, the drive rod units are relatively short so that their trailing ends can be impacted by a jackhammer or the like impacting device operated at ground level. The lead drive rod has a onvex rounded leading end bottomed in the concave rounded bottom of an upright ground anchor socket to deliver the impact blows to the ground anchor without becoming fixedly attached to the socket. This lead rod has a flat transverse trailing end and several turns of a smooth rolled external thread surround this trailing end. One or more intermediate drive rods having flat transverse ends and several turns of a smooth rolled external thread adjacent these ends are coupled in succession to the lead rod by couplers or sleeves which have several turns of an internal thread at both ends thereof separated by a central slide chamber. The threaded portions of the rods are threaded through and beyond the internal threads of the couplers so that the adjoining rod ends can slide in the chamber of the coupling and impact together during impact blows.

The trailing drive rod of the string has a leading end like the intermediate rod sections to be threaded through the threaded end of the sleeve on the trailing end of the adjacent intermediate rod. However, this endmost rod of the drive rod string is preferably equipped with a trailing shank for insertion in the bottom cup housing of a standard jackhammer and also has a radiating collar or flange to be engaged by the locking finger of the hammer.

A drive rod or gad string kit, according to this invention, preferably also includes an extractor rod to replace the jackhammer driving shank rod in the event the driving rod string becomes locked in the ground and resists retraction by the jackhammer after the ground anchor has been installed to its desired depth. This extractor rod provides an above ground member adapted to be engaged by an above ground pulling device.

This invention will be further understood by those skilled in this art from the attached drawings of a best mode embodiment of the invention and the following descriptions of the drawings.

ON THE DRAWINGS

BRIEF DESCRIPTION OF THE PREFERRED EMBODIMENTS AS SHOWN ON THE DRAWINGS

Figure 1:
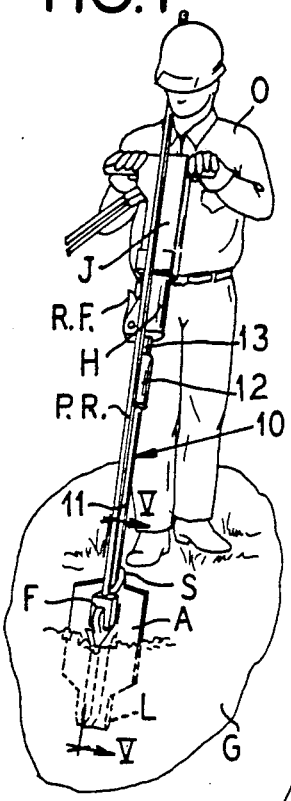
FIGS. 1-4 are schematic illustrations of the steps of installing ground anchors with drive rods or gads of this invention.
Figure 2:
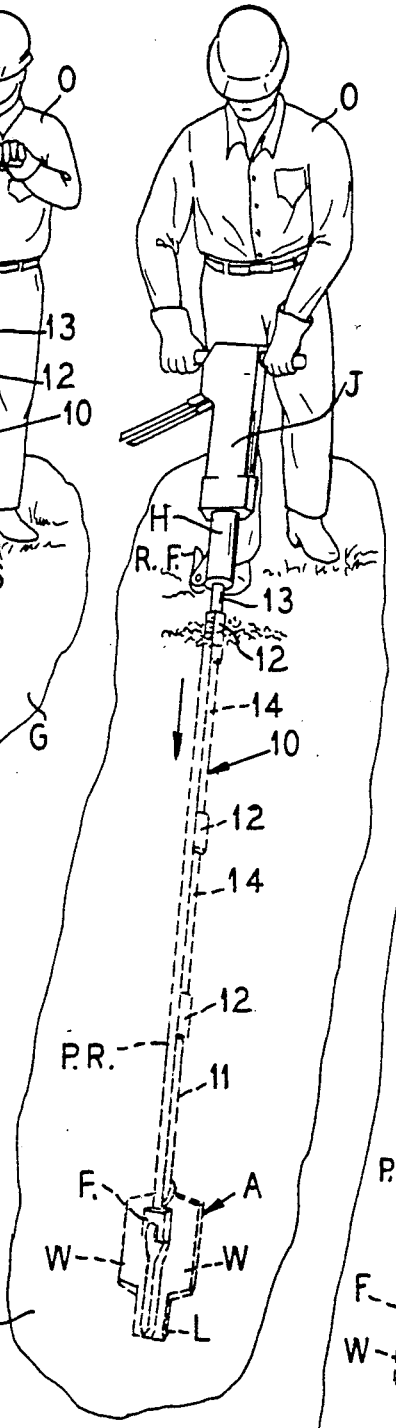
Figure 3:
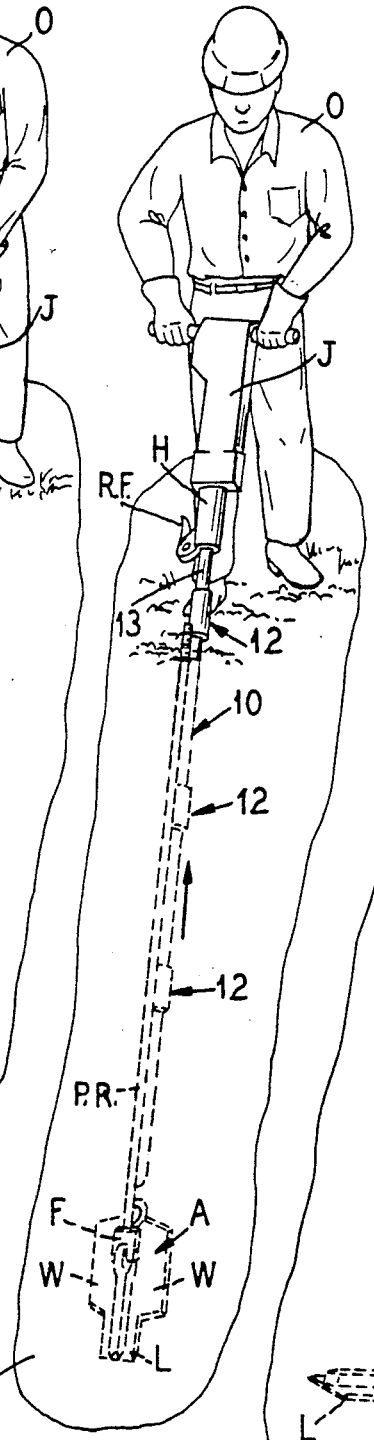

FIGS. 1-4 of the drawings illustrate the successive steps of installing a ground anchor according to this invention. As illustrated in FIGS. 1-3, a drive rod or gad string 10 of this invention drives an upright ground anchor A into the ground G by impact blows delivered from a jackhammer J held by an operator O standing on the ground G. The illustrated anchor A is of the type disclosed and claimed in the David R. Chandler U.S. Pat. No. 4,802,317 issued Feb. 7, 1989, the disclosure of which is incorporated by reference into this application.

Figures 5, 6, 7, 8, 9:
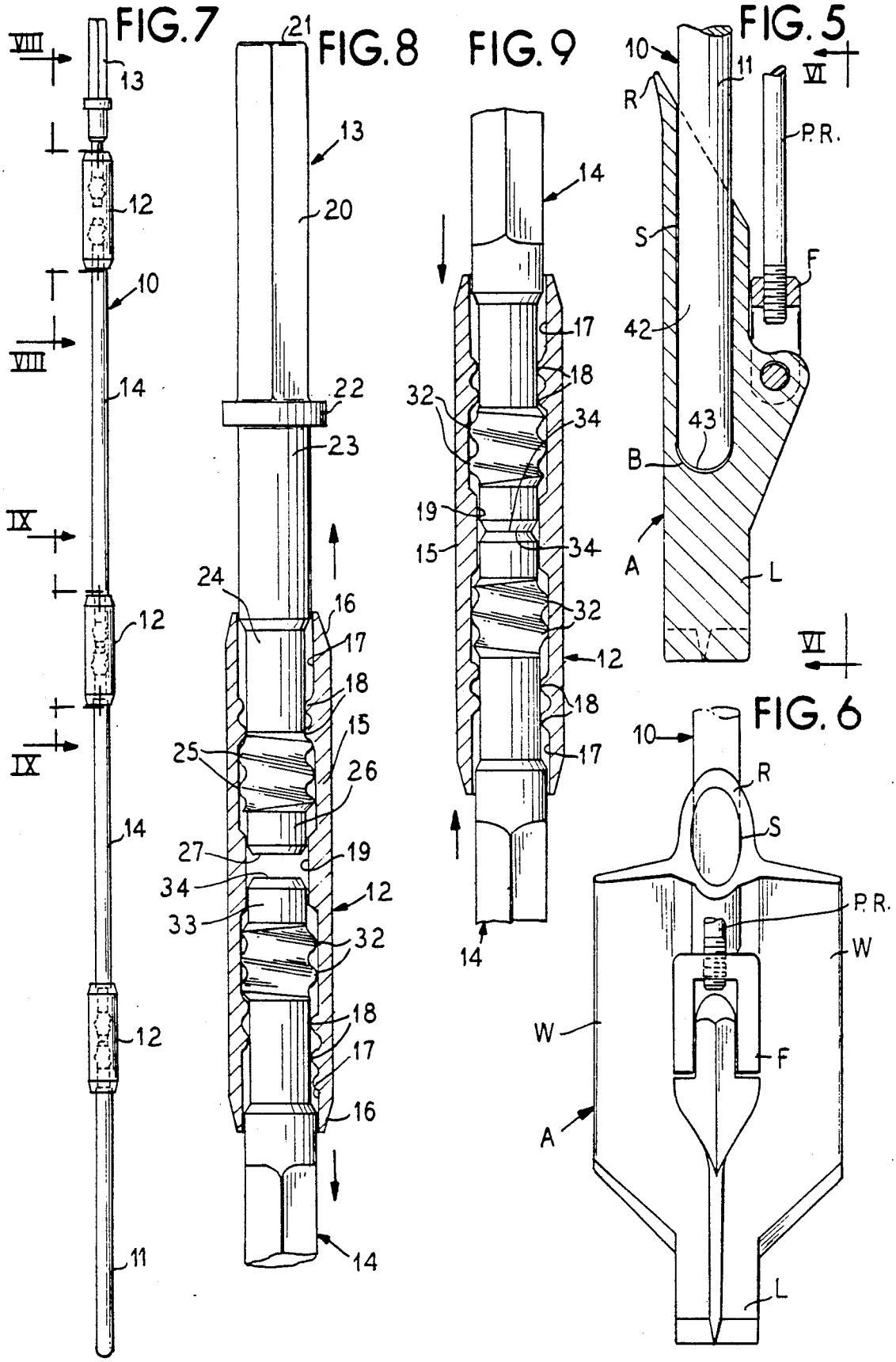
FIG. 5 is a cross-sectional view, with parts in elevation, along the line V—V of FIG. 1.
FIG. 6 is a front face view along the line VI—VI of the assembly of FIG. 5.
FIG. 7 is a longitudinal view of a string of drive rods or gads according to this invention.
FIG. 8 is a view along the line VIII—VIII of FIG. 7 showing the adjoining drive rods or gads under tension with the rod end separated.
FIG. 9 is a view similar to FIG. 8 taken along the line IX—IX of FIG. 7 and showing the adjacent drive rods under compression load with their adjoining ends abutted together.

The ground anchor A as more particularly shown and described in the Chandler U.S. Pat. No. 4,802,317 is a plate-like member with a forwardly projecting leg L, laterally extending wings W, an open top socket S with a rounded bottom B and a trailing outturned rim R, all as shown in FIGS. 5 and 6. A rib on the front face of the plate swingably mounts a shackle or finger F into which is threaded the leading end of a pull rod P.R. to rotate the anchor A from its upright driving position of FIGS. 1-3 to its flatwise anchor position of FIG. 4.

Figure 4:
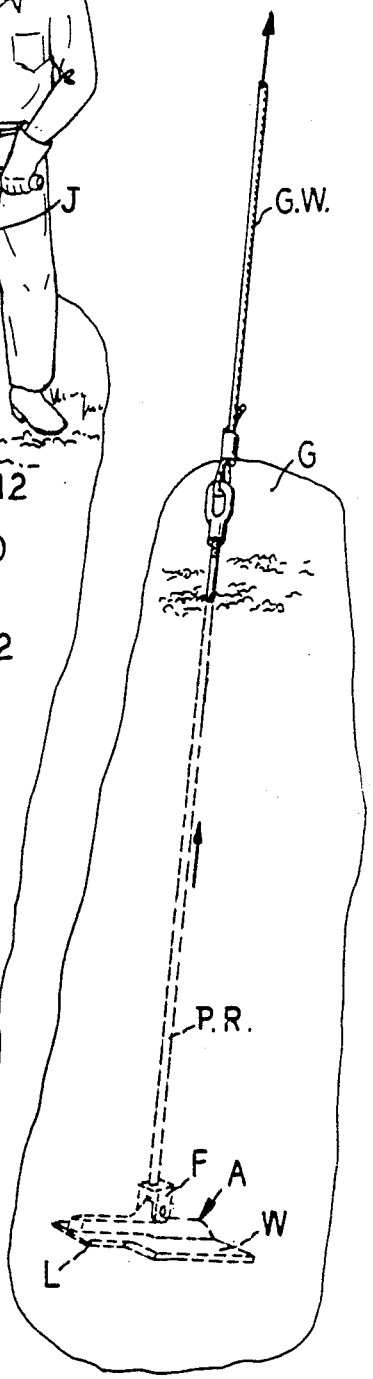

As shown in FIG. 1, the drive rod or gad string 10 for the starting operation is initially composed of a lead rod section 11, a first sleeve or coupler 12 and a trailing jackhammer shank rod 13 slidably retained in the housing H of the jackhammer J by a retainer finger R.F. The forward end of the lead rod or gad 11 is seated in the socket S of the anchor A. This anchor is in its upright or endwise position with the forward projecting leg L illustrated as entering into the ground G. The elongated pull rod P.R. as illustrated is threaded into the finger F of the anchor and draped over the shoulder of the operator O. This rod P.R. is sufficiently long to project above the ground G when the anchor is installed and rotated to its locking position as shown in FIG. 4 whereupon its projecting end may be coupled to a rod or guy wire G.W. for a utility pole or the like.

The lead drive rod or gad 11 and the trailing jackhammer shank rod 13 coupled by the sleeve 1 have a combined length which is short enough so that the jackhammer J driving the shank 13 will have its operating handles at a level to be conveniently grasped by the Operator O at about shoulder height when he is standing on the ground G for the start of the driving operation. The jackhammer is then operated to drive the anchor A into the ground for the full length of the lead drive rod or gad 11 whereupon the first coupler 12 will be adjacent ground level.

When the initial driving of the assembly has been completed, the jackhammer shank rod 13 is either removed from the coupling sleeve 12 or the coupling sleeve 12 is removed from the lead rod 10 and, as illustrated in FIG. 2, an intermediate coupling rod or gad 14 is coupled to the trailing end of the lead rod 11 through the coupler or sleeve 12 and the driving operation is repeated until the trailing end of this intermediate rod and the sleeve thereon is just above ground level. This operation is then followed up if necessary, by the addition of one or more intermediate drive rods 14 or gads as illustrated in FIG. 2 until the ground anchor A has reached the desired depth in the ground G.

As the anchor A is being driven to its desired depth in the ground, the pull rod P.R. follows the anchor. It will be noted from FIG. 2 that when the drive rod string or its component parts have been driven to ground level, the jackhammer J is conveniently grasped by the operator O at about knee level while his feet remain on the ground. Thus, the lengths of the component rods 11, 13 and 14 of the string 10 are sufficiently short so that the operator of the jackhammer is always in a comfortable position. Convenient lengths for the component rods are from two to three feet with the jackhammer shank rods being about 1-½ feet and the sleeves being about 8-10".

Figure 14:
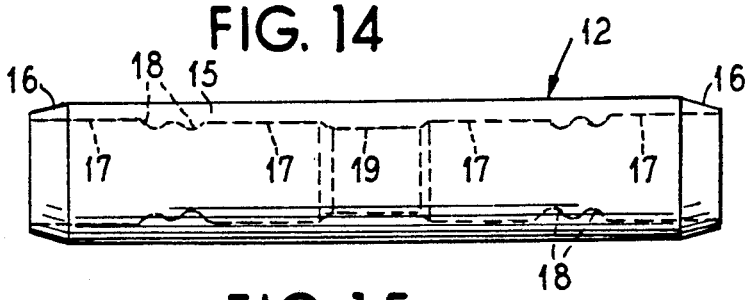
FIG. 14 is an elevational view of a coupler of this invention illustrating the interior of the coupler in dotted lines.

As illustrated in FIGS. 8, 9, and 14, the sleeves or couplers 12 of this invention are metal tubes 15 with beveled ends 16 and have smooth, cylindrical bores 17 inwardly from these beveled ends 16. About two or three turns of an internal smooth rolled rope thread 18 project into the bores 17 in spaced relation inwardly from the tapered ends 16. These threads 18 are followed by a continuation of the bores 17. The threads are preferably left handed but can be of either hand.

A reduced diameter bore 19 at the center of the sleeve 15 is provided between the opposed bores 17. This reduced diameter bore 19 provides a slide chamber for the ends of the drive rods or gads coupled together by the sleeve as will be hereinafter more fully described.

Figure 10:
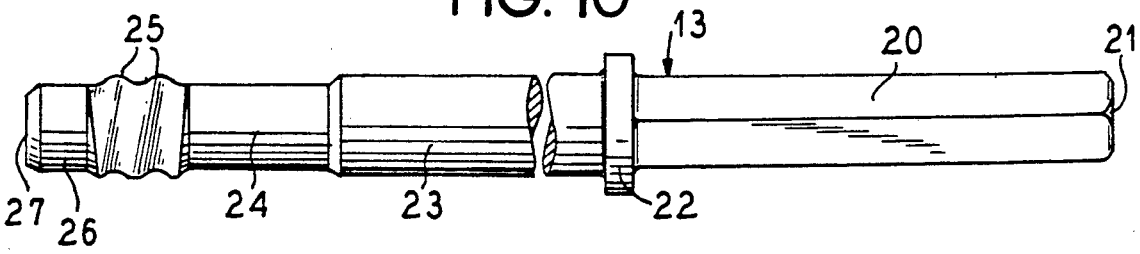
FIG. 10 is a broken side elevational view of an elongated jackhammer shank rod for the drive rod string of this invention.

As illustrated in FIG. 10, the drive shank component 13 of the drive rod or gad string 10 is a solid hardened steel rod with a trailing, preferably hexagonal, rod portion 20 projecting freely through the cup housing H of the jackhammer J with a flat transverse end 21 to be impacted by the conventional driving piston (not shown) of the jackhammer J. A radial collar or flange 22 is provided between this hexagonal end portion 20 and a cylindrical rod portion 23. This collar or flange, as explained above, is engaged by the retaining finger R.F. of the jackhammer J to retain the rod member 13 in coupled relation with the jackhammer J while accommodating free reciprocation of the rod in the jackhammer for delivering the impact blows.

The cylindrical portion 23 of the drive shank component forwardly of the collar or flange 22 leads to a reduced diameter portion 24 on which is formed about two or three turns of an external smooth rolled rope thread 25 to mate with the internal threading of a coupler 12. A plain cylindrical portion 26 of the same diameter of the portion 24 extends beyond the threads 25 and terminates in a flat transverse impacting end 27.

As illustrated in FIG. 8, the threads 25 of the rod member 13 are threaded through and beyond the internal threads of the sleeve 12 so that the cylindrical portion 26 of the rod slides in the bore in the central portion of the sleeve. The flat end 27 of the rod member 13 is thus slidably retained in the chamber provided by the bore 19 since the external threads 25 projecting beyond the internal threads 18 will prevent retraction from the sleeve 12 until the sleeve is rotated relative to the rod 13 to unthread the rod from the sleeve.

Figure 11:
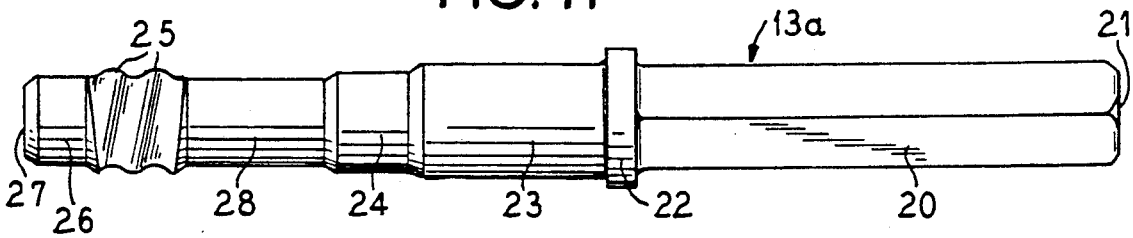
FIG. 11 is a view similar to FIG. 10 but illustrating a modified form of jackhammer shank rod of this invention.

In a modified embodiment **13*a* of the jackhammer impact rod, shown in FIG. 11, parts identical with the parts shown in FIG. 10 are marked with the same reference numerals. However, in the embodiment 13*a*, the rod is shorter and the reduced diameter cylindrical portion 24 has a further reduced diameter cylindrical portion 28 leading to the external threads 25. The three stage cylindrical portions 23, 24 and 28** are useful in some installations where increased diameter impact rods are required.

Figure 12:
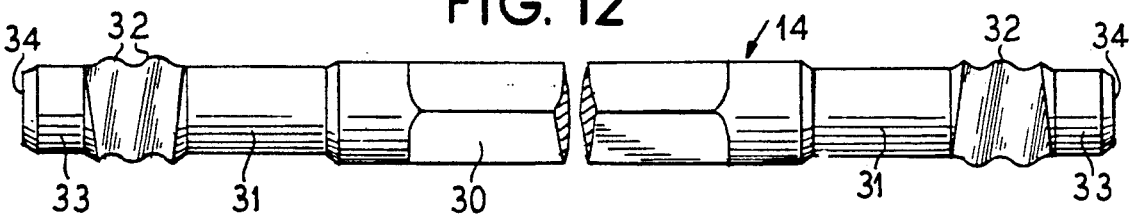
FIG. 12 is a broken elevational view of an intermediate drive rod or gad of this invention.

As shown in FIG. 12, an intermediate rod component 14 in the string assembly 13 is illustrated as having a hexagonal central portion 30 with reduced diameter cylindrical portions 31 projecting therefrom and leading to external threads 32 of greater diameter. These threads are also preferably about two or three turns of a smooth rolled rope-type thread and extend to cylindrical end portions 33 which terminate in flat transverse impact ends 34.

As illustrated in FIG. 8, the trailing end of the rod member 14 is threaded through and beyond the threads 18 of the sleeve or coupler 12 with the cylindrical end portion 33 sliding in the bore 19 and with the impact end 34 opposing but spaced from the impact end 27 of the rod 13.

The opposite direction arrows of FIG. 8 illustrate that the assemblies of the rods 13 and 14 are under tension with ends 27 and 34 separated but coupled together by the sleeve 12.

By contrast, as illustrated in FIG. 9, the illustrated components 14 of the string assembly 10 are under compression load with their impact ends 34 in full abutting relation. The direction arrows of FIG. 9 illustrate the compression force when the string assembly 10 is under impact loads from the jackhammer. It will be especially noted that the ends of the rods 14 within the sleeve 12 are free to slide in the sleeve because their threads 32 are beyond the threads 18 of the sleeve.

Thus, all compression loads created by the impact blows of the jackhammer on the string assembly are directly delivered to the rod components without any stress being placed on a sleeve or coupler 12. Therefore, in the driving operations of FIGS. 1 and 2, the sleeves or couplers 12 are not stressed and the impact blows are directly delivered to the rod components. However, when the string assembly 10 is to be pulled out of the anchor A as illustrated in FIG. 3, the sleeves 12 will hold the rod components in coupled relation.

Figure 13:
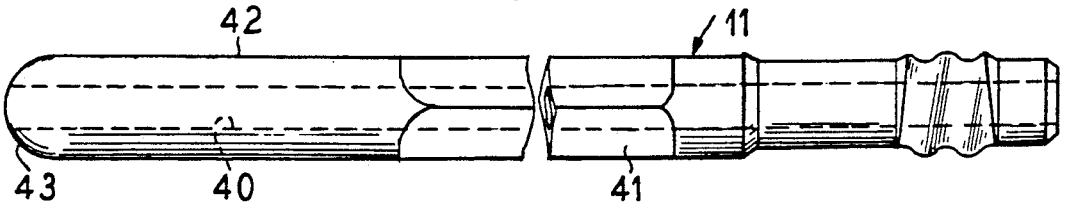
FIG. 13 is a broken elevational view of a lead drive rod of this invention.

As illustrated in FIG. 13, the lead rod component 11 may be hollow having a cylindrical bore 40 therethrough. This lead component 11 preferably has a hexagonal central portion 41, and a cylindrical forward portion 42 leading to a convex rounded end portion 43. The portion 42 fits freely in the socket S of the anchor A with the rounded convex bottom 43 seated on the concave bottom B of the socket. This arrangement provides for delivery of the impact blows to the anchor A in axial alignment between the anchor and drive rods without permitting any mushrooming or enlargement of the end 43 into locked engagement with the socket S of the anchor. Therefore, the string 10 of drive rod components can be retracted from the anchor A by pulling up the jackhammer J as illustrated in FIG. 3.

Figure 15:
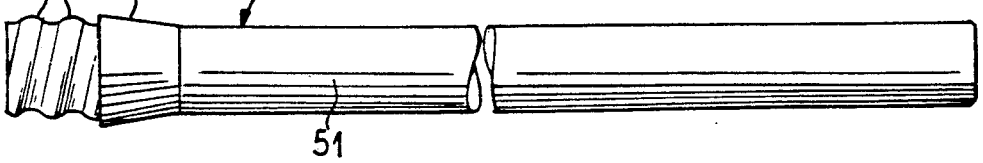
FIG. 15 is a broken longitudinal view of an extractor rod to replace the jackhammer shank rods of FIGS. 10 and 11 when the string is stuck in the ground.

In the event the string assembly 10 is retained by the surrounding earth so that an upward pulling of the jackhammer J will not dislodge it from the earth, an extension rod component 50 shown in FIG. 15 can replace the jackhammer impact rod 13. This retraction rod is a cylindrical rod member 51 with a diverging conical end 52 having an external thread 53 projecting therefrom for mating with the internal thread of the trailing sleeve or coupler 12 of the string 10. The cylindrical rod portion 51 is of sufficient length so that it can be grasped bY a pulling tool above the ground to retract the string 10 out of the ground.

From the above descriptions and illustrations, it should be readily understood by those skilled in this art that this invention greatly advances the art of driving components into the ground by impacts or other externally applied driving forces.

I claim as my invention:

1. A coupler for drive rods having threaded external end portions of larger diameter than adjacent rod portions and projecting cylindrical guide portions of lesser diameter than the threaded portions terminating in impact receiving end faces which comprises a sleeve having internal threads at the ends thereof adapted to receive the external threaded end portions of the drive rods in threaded engagement and extend completely therethrough to retain the drive rods in the sleeve when their threaded ends are in the sleeve inward from and beyond the threads of the sleeve, said sleeve having a reduced diameter slide chamber between the internally threaded end portions thereof for slidably supporting the guide portions of the drive rods in opposed aligned end to end relation when the external threaded end portions of the drive rods are in the sleeve beyond the internal threads of the sleeve and said external threads of the rods are held in the sleeve by the internal threads of the sleeve whereby the sleeve retains the rods together under tension loads and slidably supports the rods in alignment for abutment in the slide chamber under compression loads.

2. A drive rod string adapted for installing ground anchors and the like which comprises a plurality of drive rods in end to end relation, said drive rods having impact receiving ends and external threads adjacent said ends, coupling sleeves connecting said rods in end to end relation, said sleeves each having internal threads adjacent the ends thereof adapted to mate with the threaded ends of the rods, said sleeves having a slide chamber between the threaded ends thereof, said external threads of said rods adapted to be threaded through and beyond the threaded ends of the sleeves with their impact receiving ends slidably mounted in the slide chambers of the sleeves, between the threaded ends of the sleeves and said impact receiving ends of said rods are adapted to be impacted against each other under compression loads while the threaded ends of the rods and the internal threads of the sleeves retain the rods in aligned slidable end to end relation under tension loads.

3. The coupler of claim 1, wherein the threads are smooth rolled rope threads.

4. The coupler of claim 1, wherein the threads are of the same hand.

5. The coupler of claim 1, wherein the threads are left handed.

6. The string of claim 2, wherein the drive rods are short to accommodate initial impact by an operator standing on the ground.

7. The string of claim 2, wherein the lead drive rod has a convex round leading end for bottoming in the socket of a ground anchor.

8. The string of claim 2, wherein the trailing drive rod is a jackhammer receiving member.

9. The string of claim 9, wherein the jackhammer receiving member has a radial collar for coupling to the jackhammer.

10. The string of claim 9, including a replacement pull rod for the jackhammer receiving member.

11. A coupler for drive rods having enlarged diameter threaded end portions, cylindrical guide portions adjacent the end portions, and impact receiving end faces which comprises a sleeve having internal threads at the ends thereof adapted to mate with and receive the threaded end portions of the drive rods completely therethrough and retain the drive rods in the sleeve when their threaded ends are inward from and beyond the threads of the sleeve, slide walls in the sleeve to slidably support the guide portions of the rods to hold the rods and sleeve in axial alignment when the rod threads are threaded into the sleeve beyond the threads of the sleeve, and said external threads of the rod retaining the rods in the sleeve when threaded beyond the internal threads of the sleeve, whereby said sleeve retains the rods together under tension loads and slidably supports and aligns the rods for abutment under compression loads.

* * * * *